US008034757B2

(12) United States Patent
Murata et al.

(10) Patent No.: US 8,034,757 B2
(45) Date of Patent: Oct. 11, 2011

(54) DETERGENT COMPOSITION FOR CLOTHING

(75) Inventors: Daiya Murata, Wakayama (JP); Takanori Kotera, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/808,077

(22) PCT Filed: Dec. 26, 2008

(86) PCT No.: PCT/JP2008/073960

§ 371 (c)(1),
(2), (4) Date: Jun. 14, 2010

(87) PCT Pub. No.: WO2009/084729

PCT Pub. Date: Jul. 9, 2009

(65) Prior Publication Data

US 2010/0292123 A1 Nov. 18, 2010

(30) Foreign Application Priority Data

Dec. 28, 2007 (JP) ..... 2007-338871
Dec. 28, 2007 (JP) ..... 2007-338872

(51) Int. Cl.
*C11D 1/14* (2006.01)
*C11D 1/29* (2006.01)
*C11D 1/72* (2006.01)
*C11D 3/37* (2006.01)

(52) U.S. Cl. ..... 510/340; 510/351; 510/353; 510/356; 510/357; 510/358; 510/360; 510/421; 510/426; 510/475; 510/492; 510/506; 510/535

(58) Field of Classification Search ..... 510/340, 510/351, 353, 356, 357, 358, 360, 421, 426, 510/475, 492, 506, 535
See application file for complete search history.

(56) References Cited

U.S. PATENT DOCUMENTS

| | | | | |
|---|---|---|---|---|
| 4,430,237 | A * | 2/1984 | Pierce et al. | 510/422 |
| 6,387,867 | B1 | 5/2002 | Ishikawa et al. | |
| 2010/0120653 | A1 | 5/2010 | Kotera et al. | |
| 2010/0298199 | A1 * | 11/2010 | Ozeki et al. | 510/334 |

FOREIGN PATENT DOCUMENTS

| | | | |
|---|---|---|---|
| EP | 2003192 | A2 | 12/2008 |
| JP | 3-174496 | A | 9/1991 |
| JP | 4-506367 | A | 11/1992 |
| JP | 7-500861 | A | 1/1995 |
| JP | 10-500166 | A | 1/1998 |
| JP | 11-310792 | A | 11/1999 |
| JP | 2001-49290 | A | 2/2001 |
| JP | 2001-49291 | A | 2/2001 |
| JP | 2006-169517 | A | 6/2006 |
| JP | 2006-348084 | A | 12/2006 |
| WO | WO 91/00331 | A1 | 1/1991 |
| WO | WO 93/09214 | * | 5/1993 |
| WO | WO 93/09214 | A1 | 5/1993 |
| WO | WO 95/31525 | A1 | 11/1995 |
| WO | WO 2007/114484 | * | 10/2007 |
| WO | WO 2007/114484 | A1 | 10/2007 |
| WO | WO 2008/126908 | A1 | 10/2008 |

OTHER PUBLICATIONS

International Preliminary Report on Patentability and Written Opinion of the International Searching Authority (Forms PCT/IB/338, PCT/IB/373 and PCT/ISA/237) mailed Aug. 19, 2010 for International Application No. PCT/JP2008/073960.
Haruhiko Okuyama et al., Senzai Senjo no Jiten, 1st Edition, 1st print, Asakura Publishing Co., Ltd., Nov. 25, 1990, pp. 107 to 116.
International Search Report, dated Mar. 17, 2009, issued in corresponding application PCT/JP2008/073960.

* cited by examiner

*Primary Examiner* — Brian P Mruk
(74) *Attorney, Agent, or Firm* — Birch, Stewart, Kolasch & Birch, LLP

(57) ABSTRACT

The present invention provides a detergent composition for clothing containing components (a) and (b): (a) glyceryl or polyglyceryl monoether represented by formula (I); and (b) a sulfate selected from those represented by formulae (II), (III), and (IV). Component (a) contains compounds having different condensation degrees of glycerol n's, with the proviso that when component (b) is a sulfate represented by formula (II) or (III), component (a) has a condensation degree of glycerol n of 3 to 5. Formula (I) is $R—O—(C_3H_6O_2)_n—H$ (I), wherein R represents a hydrocarbon group having 6 to 22 carbon atoms; and n represents a condensation degree of glycerol and is an integer. Formulas (II)-(IV) are: $R^1—O—SO_3M$ (II); $R^1—O-(EO)_m-(AO)_l—SO_3M$ (III); and $R^1—O-(A^1O)_p-(AO)_q—SO_3M$ (IV). In formulas (II-(IV), $R^1$ represents a hydrocarbon group having 6 to 22 carbon atoms; EO represents an oxyethylene group; AO represents an oxyalkylene group, at least one of a plurality of AOs being an oxyethylene, oxypropylene, or oxybutylene group; m represents an integer of 1 to 10; l represents an integer of 0 to 10; $A^1O$ represents an oxypropylene group and/or an oxybutylene group; p represents an integer of 1 to 5; q represents an integer of 0 to 10; and M represents an alkali metal, alkaline earth metal, $NH_4$, or alkanolammonium group having 2 to 3 carbon atoms.

7 Claims, No Drawings

DETERGENT COMPOSITION FOR CLOTHING

FIELD OF THE INVENTION

The present invention relates to a detergent composition for clothing.

BACKGROUND OF THE INVENTION

For increasing detergency, nonionic surfactants such as glyceryl monoalkylether or polyglyceryl monoalkylethers, produced with glycerol derived from natural oil-and-fats, mainly vegetable, have recently been blended to detergents. Such detergent compositions are disclosed in JP-A2001-49290, JP-A2001-49291, JP-A1'-310792, JP-A4-506367, JP-A7-500861, JP-A3-174496, and JP-A2006-348084.

WO-A 2008/126908, published on Oct. 23, 2008, discloses a detergent composition for clothing containing polyglyceryl monoethers, containing compounds having different condensation degrees n's of glycerol. The content of compounds having condensation degrees n's of glycerol of 3 to 5 is not less than 40% by mass.

SUMMARY OF THE INVENTION

The present invention provides a detergent composition for clothing containing:

(a) glyceryl monoether or polyglyceryl monoether, represented by formula (I) [hereinafter, referred to as component (a)]; and (b) a sulfate selected from those represented by formulae (II), (III), and (IV) [hereinafter, referred to as component (b)], wherein component (a) contains plural compounds having different condensation degrees n's of glycerol, provided that, when component (b) is a sulfate represented by formula (II) or (III), component (a) has a condensation degree n of glycerol of 3 to 5:

$$R—O—(C_3H_6O_2)_n—H \quad (I)$$

wherein, R represents a hydrocarbon group having 6 to 22 carbon atoms; and n represents a condensation degree of glycerol and is an integer:

$$R^1—O—SO_3M \quad (II)$$

$$R^1—O\text{-}(EO)_m\text{-}(AO)_1—SO_3M \quad (III)$$

$$R^1—O\text{-}(A^1O)_p\text{-}(AO)_q—SO_3M \quad (IV)$$

wherein, $R^1$ represents a hydrocarbon group having 6 to 22 carbon atoms; EO represents an oxyethylene group; AO represents oxyalkylene group containing at least one of oxyethylene, oxypropylene and oxybutylene group; m represents an integer of 1 to 10; l represents an integer of 0 to 10; $A^1O$ represents an oxypropylene group and/or an oxybutylene group; p represents an integer of 1 to 5; q represents an integer of 0 to 10; and, M represents an alkali metal, an alkaline earth metal, $NH_4$ or an alkanolammonium group having 2 to 3 carbon atoms.

The present invention provides a detergent composition for clothing containing:

(a) glyceryl monoether or polyglyceryl monoether, represented by formula (I) [hereinafter, referred to as component (a)]; and (b) a sulfate selected from those represented by formulae (II) and (III) [hereinafter, referred to as component (b)], wherein component (a) contains plural compounds having different condensation degrees n's of glycerol of 3 to 5:

$$R—O—(C_3H_6O_2)_n—H \quad (I)$$

wherein, R represents a hydrocarbon group having 6 to 22 carbon atoms; and n represents a condensation degree of glycerol and is an integer:

$$R^1—O—SO_3M \quad (II)$$

$$R^1—O\text{-}(EO)_m\text{-}(AO)_l—SO_3M \quad (III)$$

wherein, $R^1$ represents a hydrocarbon group having 6 to 22 carbon atoms; EO represents an oxyethylene group; AO represents oxyalkylene group containing at least one of oxyethylene, oxypropylene and oxybutylene group; m represents an integer of 1 to 10; l represents an integer of 0 to 10; and, M represents an alkali metal, an alkaline earth metal, $NH_4$ or an alkanolammonium group having 2 to 3 carbon atoms.

The present invention provides a detergent composition for clothing containing:

(a) glyceryl monoether or polyglyceryl monoether, represented by formula (I) [hereinafter, referred to as component (a)]; and (b) a sulfate represented by formula (IV) [hereinafter, referred to as component (b)], wherein component (a) contains plural compounds having different condensation degrees n's of glycerol:

$$R—O—(C_3H_6O_2)_n—H \quad (I)$$

wherein, R represents a hydrocarbon group having 6 to 22 carbon atoms; and n represents a condensation degree of glycerol and is an integer:

$$R^1—O\text{-}(A^1O)_p\text{-}(AO)_q—SO_3M \quad (IV)$$

wherein, $R^1$ represents a hydrocarbon group having 6 to 22 carbon atoms; $A^1O$ represents an oxypropylene group and/or an oxybutylene group; AO represents oxyalkylene group containing at least one of oxyethylene, oxypropylene and oxybutylene group; p represents an integer of 1 to 5; q represents an integer of 0 to 10; and, M represents an alkali metal, an alkaline earth metal, $NH_4$ or an alkanolammonium group having 2 to 3 carbon atoms.

DETAILED DESCRIPTION OF THE INVENTION

Glyceryl monoether and polyglyceryl monoethers described above have been not fully satisfactory in detergency when used in a detergent composition for clothing. Particularly at low temperature, these monoethers exhibit high crystallinity, and thus have low solubility in water and tend to decrease detergency. The present inventors therefore have intensively studied and found that a condensation degree of glycerol and a distribution thereof have large effects on detergency.

That is, an object of the present invention is to provide a detergent composition for clothing having increased detergency and containing glyceryl monoether and polyglyceryl monoethers (hereinafter, also referred to as (poly)glyceryl monoethers) having specific condensation degrees of glycerol.

From the viewpoint of carbon cycle including increase in carbon dioxide, there is a demand for a carbon neutral material that does not increase carbon dioxide in the air. In such circumstances, glyceryl monoethers are promising, because they are produced by production expected to meet the needs.

According to the present invention, there is provided a detergent composition for clothing having good detergency and exhibiting its detergency under low temperature washing conditions.

<Component (a)>

Component (a) of the present invention is (poly)glyceryl monoethers etc, produced by substituting one hydrogen atom of hydroxy group(s) of glycerol and polyglycerols, which are condensates of glycerol, with a hydrocarbon group having 6 to 22 carbon atoms to form an ether bond.

When component (b) is a sulfate represented by formula (II) or (III), in component (a), the content (percentage) of polyglyceryl monoethers, each represented by formula (I) in which R is an alkyl group having 12 and/or 14 carbon atoms and a condensation degree n of glycerol is 3 to 5, is preferably not less than 40% by mass, more preferably not less than 50% by mass, even more preferably not less than 60% by mass, even more preferably not less than 70% by mass, even more preferably not less than 80% by mass, of compounds each having a condensation degree of glycerol n of 1 to 7. From the viewpoint of detergent performance at low temperature, the percentage is preferably not more than 99% by mass, more preferably not more than 95% by mass, even more preferably not more than 90% by mass, and particularly preferably not more than 85% by mass. From the viewpoint of detergent performance at a low temperature, component (a) preferably contains compounds represented by formula (I) and having different condensation degrees n's of glycerol, more preferably two or more compounds having different n's, even more preferably three or more compounds having different n's. In component (a), compounds each represented by formula (I) in which R is an alkyl group having 12 and/or 14 carbon atoms and a condensation degree of glycerol n is 3 to 5 exhibit the highest detergent performance. However, component (a) composed of a single compound having a single condensation degree n of glycerol, though satisfying these ranges, is easy to crystallize and decreases its solubility in water, particularly at a low temperature, resulting in tendency to decrease its detergency. In contrast, component (a) composed of compounds having different condensation degrees n's of glycerol is suppressed from crystallizing and exhibits a high solubility at a low temperature, resulting in a good detergent performance. Component (a) thus preferably contains two or more of three compounds having different condensation degrees of glycerol n's of 3 to 5, and more preferably all three compounds (n=3, 4, 5). When the percentage of polyglyceryl monoethers each represented by formula (I) in which R is an alkyl group having 12 and/or 14 carbon atoms and a condensation degree of glycerol n is 3 to 5 is not more than 99% by mass, component (a) has significantly increased solubility at low temperature, resulting in large effects of increasing detergent performance. In general, a detergent composition containing smaller amount of polyglyceryl monoethers has higher solubility at low temperature, but also lower detergent performance at ambient temperature. A content of polyglyceryl monoethers is thus required to be well balanced. A detergent composition containing polyglyceryl monoethers in a liquid form can prevent separation during storage and maintain its product value even when stored for a long time.

When component (b) is a sulfate represented by formula (IV), from the viewpoint of detergent performance at a low temperature, component (a) preferably contains two or more compounds represented by formula (I) and having different condensation degrees n's of glycerol, more preferably three or more compounds, even more preferably compounds having different condensation degrees n's of glycerol of 3 to 5, each represented by formula (I) in which R represents an alkyl group having 12 and/or 14 carbon atoms. The content (percentage) of the compounds in the total of compounds having condensation degrees n's of 1 to 7 is preferably not less than 40% by mass, more preferably not less than 50% by mass, even more preferably not less than 60% by mass, even more preferably not less than 70% by mass, and even more preferably not less than 80% by mass. From the viewpoint of detergent performance at low temperature, the percentage is preferably not more than 99% by mass, more preferably not more than 95% by mass, even more preferably not more than 90% by mass, and even more preferably not more than 85% by mass. In component (a), compounds each represented by formula (I) in which R is an alkyl group having 12 and/or 14 carbon atoms and a condensation degree of glycerol n is 3 to 5 exhibit the highest detergent performance. However, component (a) composed of a single compound having a single condensation degree of glycerol n though satisfying these ranges is easy to crystallize and decreases its solubility in water particularly at low temperature, resulting in tendency to decrease its detergency. In contrast, component (a) composed of compounds having different condensation degrees n's of glycerol is suppressed from crystallizing and exhibits a high solubility at a low temperature, resulting in good detergent performance. Component (a) thus preferably contains all three compounds having different condensation degrees of glycerol n's of 3 to 5 (n=3, 4, 5).

When the percentage of polyglyceryl monoethers each represented by formula (I) in which R is an alkyl group having 12 and/or 14 carbon atoms and a condensation degree n of glycerol is 3 to 5 is not more than 99% by mass of component (a), the invention composition has a significantly increased solubility at a low temperature, resulting in a largely increased detergent performance. In general, the smaller this percentage is, the larger the solubility at a low temperature is, but the lower the detergent performance at ambient temperature is. It is accordingly proposed that the percentage of the polyglyceryl monoethers each represented by formula (I) in which R is an alkyl group having 12 and/or 14 carbon atoms and a condensation degree n of glycerol is 3 to 5 should be given in balance. A detergent composition containing polyglyceryl monoethers in a liquid form can prevent separation during storage and maintain its product value even when stored for a long time.

In component (a) of the present invention, a total of compounds (a-1) each represented by formula (I) in which R represents an alkyl group having 12 carbon atoms and a condensation degree of glycerol n is 3 to 5 and compounds (a-2) each represented by formula (I) in which R represents an alkyl group having 14 carbon atoms and a condensation degree of glycerol n is 3 to 5 is preferably not less than 40%. Component (a) more preferably contains compounds having different n's and particularly three compounds having n of 3, 4, and 5 and selected from compounds (a-1) and (a-2).

From the viewpoint of detergency, a starting polyglycerol for component (a) preferably has a condensation degree n of glycerol of 4. In polyglyceryl ethers having condensation degrees of 1 to 7, a total of those having a condensation degree of glycerol n of 4 is preferably not less than 10% by mass, more preferably not less than 15% by mass, even more preferably not less than 20% by mass, and even more preferably not less than 30% by mass.

In component (a), a ratio of a total of polyglyceryl monoethers having condensation degrees of glycerol n's of 1 and 2 is preferably less than 50% by mass, and more preferably not more than 35% by mass. Further, in component (a), a content of glyceryl monoethers having a condensation degree of glycerol n of 1 is preferably less than 30% by mass, and more preferably not more than 20% by mass.

In formula (I), R may be a linear, branched, saturated, or unsaturated alkyl group preferably having 6 to 22 carbon atoms, more preferably 12 to 14 carbon atoms, and even more preferably 12 carbon atoms. In the total of compounds represented by formula (I) having condensation degrees of glycerol n's of 1 to 7 in component (a), a total of compounds each represented by formula (I) in which R is an alkyl group having 12 to 14 carbon atoms and particularly having 12 and/or 14 carbon atoms is preferably not less than 40% by mass, more preferably not less than 70% by mass, even more preferably not less than 90% by mass, and even more preferably not less than 95%.

In formula (I), a condensed polyglycerol group is represented by $(C_3H_6O_2)_n$. It includes not only a linear group but also a branched group and a random mixture of a linear group and a branched group. It is noted that the representation is for the sake of convenience.

A mass percentage of a condensation degree of glycerol for component (a) [mass percentage in component (a)] can be determined from a percentage by area by gas chromatography (GC).

Component (a) of the present invention can be produced, for example, by reacting an alcohol having 6 to 22 carbon atoms with a predetermined amount of 2,3-epoxy-1-propanol (glycidol) in the presence of an alkali catalyst, or by a method described in paragraphs 0007 to 0011 in JP-A 2000-160190.

A binding mode of glycerol in component (a) may be either a linear mode (glycerol binds at 1- and 3-positions) or a branched mode (glycerol binds at 1- and 2-positions, or glycerol binds at 1- and 2-position to a second glycerol and further a third glycerol binds to 1- and 3-positions of the second glycerol having bonded at 2-position or the like).

In general, polyglyceryl monoethers of component (a) are produced as a mixture of compounds having different condensation degrees. From the viewpoint of detergency, in order to use, in the present invention, plural compounds having different condensation degrees of glycerol of 3 to 5 or plural compounds having different condensation degrees n's, preferably a predetermined content of compounds having condensation degrees of glycerol of 3 to 5, a product mixture is purified according to need, for example, by distillation etc. to obtain the compounds.

<Component (b)>

Component (b) used in the present invention is a sulfate selected from those represented by formulae (II), (III), and (IV).

The sulfate selected from those represented by formulae (II) and (III) will be described in detail below.

The compound represented by formula (II) includes an alkylsulfate. The compound represented by formula (III) includes an alkyl ether sulfate.

$$R^1—O—SO_3M \quad (II)$$

$$R^1—O-(EO)_m-(AO)_l—SO_3M \quad (III)$$

wherein, $R^1$ represents a hydrocarbon group having 6 to 22 carbon atoms; EO represents an oxyethylene group; AO represents an oxyalkylene group, and at least one AO represents an oxyethylene, oxypropylene, or oxybutylene group; m represents an integer of 1 to 10; l represents an integer of 0 to 10; M represents an alkali metal, an alkaline earth metal, an $NH_4$ group, or an alkanol ammonium group having 2 to 3 carbon atoms.

In formulae (II) and (III), a hydrocarbon group as $R^1$ is preferably an alkyl group having 8 to 16 carbon atoms, more preferably having 10 to 14 carbon atoms, and even more preferably having 12 to 14 carbon atoms. From the performance viewpoints of foaming power and emulsifying power and the environmental viewpoint of carbon neutrality, the hydrocarbon group is more preferably a linear alkyl group, and particularly preferably a linear alkyl group derived from natural oil-and-fat sources.

In formula (III), oxyalkylene groups as AOs contain at least one oxyethylene, oxypropylene, or oxybutylene group. Oxyalkylene groups may contain two or more of these groups.

A compound represented by formula (III) has a structure in which EO binds to $R^1$—O—. When AOs contain two or more different oxyalkylene groups, these may be arranged in a block addition or random addition mode. When AOs contain only EO, a compound represented by formula (III) is an ethylene oxide adduct represented by $R^1$—O-$(EO)_{m+1}$—$SO_3M$.

In formula (III), m represents an addition mole number of (EO) and is an integer ranging from 1 to 10, and from the viewpoints of production efficiency and detergent performance, preferably an integer of 1 to 5, more preferably an integer of 1 to 3.

In formula (III), l represents an addition mole number of (AO). From the viewpoint of detergency and the like, l is an integer ranging from 0 to 10. The number preferred for l is varied according to the number of m.

The sulfate represented by formula (IV) will be described in detail below.

The compound represented by formula (IV) includes an alkyl ether sulfate.

$$R^1—O-(A^1O)_p-(AO)_q—SO_3M \quad (IV)$$

wherein, $R^1$ represents a hydrocarbon group having 6 to 22 carbon atoms; $A^1O$ represents an oxypropylene group and/or oxybutylene group; AO represents an oxyalkylene group, and AO includes at least one of an oxyethylene, oxypropylene and oxybutylene group; p represents an integer of 1 to 5; q represents an integer of 0 to 10; and M represents an alkali metal, an alkaline earth metal, an $NH_4$ group, or an alkanol ammonium group having 2 to 3 carbon atoms.

In formula (IV), a hydrocarbon group as $R^1$ is preferably an alkyl group having 8 to 16 carbon atoms, more preferably having 10 to 14 carbon atoms, and even more preferably having 12 to 14 carbon atoms. From the performance viewpoints of foaming power and emulsifying power and the environmental viewpoint of carbon neutrality, the hydrocarbon group is more preferably a linear alkyl group, and particularly preferably a linear alkyl group derived from natural oil-and-fat sources.

In formula (IV), oxyalkylene groups as $A^1Os$ may contain at least one of oxyethylene and oxybutylene group or combined oxyalkylene groups of two or more of these groups. $A^1Os$ preferably contain an oxypropylene group and are preferably connected to $R^1$—O— at an oxypropylene group.

In formula (IV), oxyalkylene groups as AOs contain at least one oxyethylene (hereinafter, also referred to as EO), oxypropylene (hereinafter, also referred to as PO), or oxybutylene (hereinafter, also referred to as BO) group. Oxyalkylene groups may contain two or more of these groups.

A compound represented by formula (IV) has a structure in which a PO group and/or an BO group binds to $R^1$—O—. When $A^1Os$ contain both PO and BO groups as the oxyalkylene groups, these may be arranged in a block addition or random addition mode. When $A^1O$ and AO each represent a PO group, the compound represented by formula (IV) is a propylene oxide adduct represented by $R^1$—O—$(PO)_{p+q}$—$SO_3M$. The compound having a structure in which PO group and then BO group is added to $R^1$—O— is a propylene oxide.butylene oxide adduct represented by $R^1$—O—$(PO)_s$—$(BO)_t$—$SO_3M$. When the value of s+t is within the range of p, the compounds are considered as q=0. The same is applicable to the compound in which $R^1$—O— is connected to a BO group and then a PO group.

In formula (IV), p represents an addition mole number of ($A^1O$) and is an integer ranging from 1 to 5, and from the viewpoints of production efficiency and detergent performance, preferably an integer of 1 to 4, more preferably an integer of 1 to 3.

In formula (IV), q represents an addition mole number of (AO). From the viewpoint of detergency and the like, q is an integer ranging from 0 to 10. The number preferred for q is varied according to the number of p.

In formulae (II), (III), and (IV), M is a cation group forming a salt, including an alkali metal ion, an alkaline earth metal ion, an ammonium ion, and an alkanolammonium ion.

Examples of the alkali metal for forming M include sodium, potassium, and lithium. Examples of the alkaline earth metal include calcium. Examples of the alkanolammonium ion include triethanolammonium ion. Among them, preferred are alkali metals such as sodium and potassium, and particularly preferred is sodium.

From the viewpoint of ease of handling, component (b) is preferably in the form of powder. Component (b) may also be in a form of water-containing paste or the like.

Component (b) represented by formula (II) or (III) can be produced by any method without specific limitation. For example, the compound represented by formula (II) can be produced by a method including sulfating an alcohol having a hydrocarbon group having 6 to 22 carbon atoms and neutralizing [hereinafter, referred to as step (A)].

The compound represented by formula (II) can be produced by a method including the steps (X) to (Z).

step (X): adding ethylene oxide to an alcohol having a hydrocarbon group having 6 to 22 carbon atoms at an average amount of more than 0 mole to not more than 10 moles per mole of the alcohol step (Y): adding an alkylene oxide containing at least one of ethylene oxide, propylene oxide, and butylene oxide to the ethylene oxide adduct of the step (X) at an average amount of not less than 0 mole to not more than 10 moles to give an alkoxylate step (Z): sulfating the alkoxylate of the step (Y) and neutralizing.

The reaction product obtained by the method may be a mixture of compounds represented by formulae (I) to (iv). Among these compounds, the compound represented by formula (i) is the sulfate represented by formula (II), and the compound represented by formula (iv) is the sulfate represented by formula (III).

$$R^1\text{—O—}SO_3M \quad \text{(i)}$$

$$R^1\text{—O-}(EO)_x\text{—}SO_3M \quad \text{(ii)}$$

$$R^1\text{—O-}(AO)_y\text{—}SO_3M \quad \text{(iii)}$$

$$R^1\text{—O-}(EO)_z\text{-}(AO)_{z'}\text{—}SO_3M \quad \text{(iv)}$$

In formulae (II) to (iv), x, y, z, and z' each represent an integer of not less than 1; $R^1$ and M represent the same meanings as $R^1$ and M in formulae (II) and (III).

From the viewpoints of versatility and ease of handling, a hydrocarbon group of the alcohol in the steps (A) and (X) is preferably an alkyl group having 8 to 16 carbon atoms, more preferably 10 to 14 carbon atoms, and even more preferably 12 to 14 carbon atoms. From the viewpoints of foaming power and emulsifying power, the hydrocarbon group is preferably a linear alkyl group.

In the step (X), an amount of ethylene oxide used is such that an average addition mole number of ethylene oxide per mole of the alcohol is more than 0 and not more than 10.

In the step (Y), an amount of the alkylene oxide used is such that an average addition mole number of ethylene oxide per mole of the ethylene oxide adduct of the step (X) is 0 to 10.

The steps (A), (X) and (Y) can be conducted by a conventional method. That is, an alcohol or an ethylene oxide adduct and a catalyst such as KOH in an amount of 0.5 to 1% by mol with respect to the alcohol or the ethylene oxide adduct fed to a reactor, heated and dehydrated, and reacted with ethylene oxide or an alkylene oxide at a predetermined amount at 130 to 160° C. to provide a product.

Component (b) represented by formula (IV) can be produced by any method without specific limitation, including a method including the following steps (X) to (Z), for example.

step (X): adding an alkylene oxide containing at least one of propylene oxide and butylene oxide to an alcohol having a hydrocarbon group having 6 to 22 carbon atoms in an average amount of more than 0 mole to not more than 5 moles per mole of the alcohol step (Y): adding an alkylene oxide containing at least one of ethylene oxide, propylene oxide, and butylene oxide to the alkylene oxide adduct of the step (X) at an average amount of not less than 0 mole to not more than 10 moles to give an alkoxylate step (Z): sulfating the alkoxylate of the step (Y) and neutralizing.

The reaction product obtained by the method may be a mixture of compounds represented by formulae (i) to (iv). Among these compounds, the compound represented by formula (ii) and the compound represented by formula (iii) (wherein AO is only PO group(s) and/or BO group) and the compound represented by formula (iv) are the sulfate represented by formula (II).

$$R^1\text{—O—}SO_3M \quad \text{(i)}$$

$$R^1\text{—O-}(A^1O)_x\text{—}SO_3M \quad \text{(ii)}$$

$$R^1\text{—O-}(AO)_y\text{—}SO_3M \quad \text{(iii)}$$

$$R^1\text{—O-}(A^1O)_z\text{-}(AO)_{z'}\text{—}SO_3M \quad \text{(iv)}$$

In formulae (ii) to (iv), x, y, z, and z' each represent an integer of not less than 1, and $R^1$ and M represent the same meanings as $R^1$ and M in formula (II).

From the viewpoints of versatility and ease of handling, a hydrocarbon group of the alcohol in the step (X) is preferably an alkyl group having 8 to 16 carbon atoms, more preferably 10 to 14 carbon atoms, and even more preferably 12 to 14 carbon atoms. From the viewpoints of foaming power and emulsifying power, the hydrocarbon group is preferably a linear alkyl group.

In the step (X), an amount of the alkylene oxide used is such that an average addition mole number of the alkylene oxide per mole of the alcohol is more than 0 and not more than 5.

In the step (Y), an amount of the alkylene oxide used is such that an average addition mole number of the alkylene oxide per mole of the alkylene oxide adduct of the step (X) is 0 to 10.

The steps (X) and (Y) can be conducted by a conventional method. That is, an alcohol or an alkylene oxide adduct and a catalyst such as KOH in an amount of 0.5 to 1% by mol with respect to the alcohol or the alkylene oxide adduct are fed to a rector, heated and dehydrated, and reacted with an alkylene oxide at a predetermined amount at 130 to 160° C. to provide a product.

In production of component (b) represented by formula (II), (III), or (IV), a method of sulfation in the step (Z) includes sulfation with sulfur trioxide (liquid or gas), sulfur trioxide-containing gas, fuming sulfuric acid, and chlorosulfonic acid. Particularly from the viewpoints of preventing generation of waste sulfuric acid, waste hydrochloric acid and the like, preferred is a method of continuously supplying sulfur trioxide together with the alkoxylate in a gas or liquid state.

The sulfated product can be neutralized by any method without specific limitation. Examples of the method of neutralization include batch methods of adding the sulfated product to a given amount of neutralizer and stirring to neutralize and continuous methods of continuously supplying the sulfated product and a neutralizer into a pipe and neutralizing with a stirring mixer. Examples of the neutralizer used in this step include aqueous alkali metal solutions, ammonia water, triethanolamine etc. Preferred are aqueous alkali metal solutions, more preferred is an aqueous sodium hydroxide solution.

In the present invention, preferred are a compound represented by formula (III) in which (AO) is an EO group, a compound represented by formula (IV) in which ($A^1O$) is a PO group and (AO) is an EO group, and a compound represented by formula (IV) in which ($A^1O$) is a PO group and (AO) is a PO group.

<Component (c)>

The detergent composition for clothing of the present invention can further contain an alkali agent [hereinafter, also referred to as component (c)]. In cases of the detergent composition for clothing of the present invention in the form of powder, examples of component (c) used include carbonates, bicarbonates, silicates, orthosilicates, metasilicates, crystalline silicates, and phosphates. Salts are preferably alkali metal salts such as sodium salt and potassium salt. These alkali agents may be used alone or as a mixture thereof. Specific examples of the alkali agent include sodium carbonate, potassium carbonate, sodium hydrogen carbonate, sodium silicate No. 1, sodium silicate No. 2, sodium silicate No. 3, sodium tetraborate, sodium pyrophosphate, and sodium tripolyphosphate. As used herein, the crystalline silicate is an alkali substance such that a liquid dispersion containing 0.1% by mass thereof in ion-exchanged water at 20° C. has the maximum pH of not less than 11 and not less than 5 ml of an aqueous solution of 0.1N—HCl is required to adjust the pH of 1 L of the dispersion at 10. The crystalline silicate is distinguished from a zeolite (crystalline aluminosilicate) as component (d) described below. The crystalline silicate is preferably in a lamellar form. Those described in JP-A7-89712, JP-A60-227895, and Phys. Chem. Glasses. 7, p 127-p 138 (1966), and Z. Kristallogr., 129, p 396-p 404 (1969) can be used, for example. A crystalline silicate represented by formula $0.42Na_2O.0.14K_2O.SiO_2.0.03CaO.0.0005MgO$ is preferably used. Powder and granules of crystalline silicate are also commercially available from Hoechst, which are called "Na-SKS-6" ($\delta$-$Na_2Si_2O_5$). In cases of the detergent composition for clothing of the present invention in the form of liquid, examples of component (c) used include alkanolamines such as monoethanolamine, diethanolamine, triethanolamine, methylmonoethanolamine, dimethylethanolamine, and 3-aminopropanol, and inorganic salts such as sodium hydroxide, potassium hydroxide, sodium silicate, and sodium carbonate. Particularly preferred is at least one compound selected from monoethanolamine, sodium hydroxide, and potassium hydroxide.

A pH of the detergent composition for clothing of the present invention is preferably 7 to 14, more preferably 8 to 12, and even more preferably 9 to 11 at 20° C., when the composition is diluted to 0.1% by mass of concentration with ion-exchanged water.

<Component (d)>

The detergent composition for clothing of the present invention can further contain (d) a zeolite [hereinafter, also referred to as component (d)]. The zeolite as component (d) is a crystalline aluminosilicate, preferably a compound represented by formula (d1), and more preferably a compound represented by formula (d2):

$$a(M_2O).Al_2O_3.b(SiO_2).w(H_2O) \quad \text{(d1)}$$

wherein, M represents an alkali metal atom; a, b, and w represent molar ratios of ingredients, respectively, generally satisfying $0.7 \leqq a \leqq 1.5$, $0.8 \leqq b \leqq 6$, and w being an arbitrary positive number; and $$Na_2O.Al_2O_3.n(SiO_2).m(H_2O) \quad \text{(d2)}$$

wherein, n represents a number of 1.8 to 3; and m represents a number of 1 to 6.

Examples of component (d) include synthetic zeolites such as A, X, and P zeolites. A preferred average particle diameter of component (d) is 0.1 to 10 μm.

<Component (e)>

The detergent composition of the present invention preferably contains an alcohol having 6 to 22 carbon atoms as component (e). Combination use of the components (e) and (a) tends to suppress crystallization of component (a), and thus can further increase detergent performance at low temperature. An amount of component (e) added is 0.001 to 20% by mass, preferably 0.001 to 10% by mass, and more preferably 0.1 to 10% by mass with respect to component (a). The content of component (d) of not more than 20% by mass suppresses tendency to impair detergency by component (e) itself acting as stain.

Component (e) is preferably an alcohol having an alkyl group having 6 to 22 carbon atoms. The alkyl group may be linear or branched. Component (e) is particularly preferably 1-decanol, 1-dodecanol, or 1-tetradecanol.

<Component (f)>

The detergent composition of the present invention can further contain at least one compound as component (f) selected from glycerol and polyglycerol. Combination use of the components (f) and (a) also tends to suppress crystallization of component (a), and is preferred from the viewpoint of increasing detergent performance at low temperature. In cases of the detergent composition of the present invention in a liquid form, the combination use tends to decrease a viscosity of the detergent composition, resulting in good measurability. An amount of component (f) added is 0.001 to 50% by mass, preferably 0.001 to 20% by mass, more preferably 0.1 to 10% by mass, and even more preferably 1 to 5% by mass with respect to component (a).

Component (f) is preferably glycerol and/or polyglycerol. When component (f) is polyglycerol, a condensation degree and a binding mode thereof are not specifically limited. A condensation degree of polyglycerol may be 2 to 8. Polyglycerol may be of a chain or circle.

<Component (g)>

The detergent composition of the present invention containing the compound of formula (IV) can contain at least one surfactant as component (g) selected from (g-1) alkylsulfates having 10 to 18 carbon atoms and preferably 12 to 14 carbon atoms and polyoxyethylene alkyl (having 10 to 18 carbon atoms and preferably 12 to 14 carbon atoms) ether sulfates

[hereinafter, also referred to as component (g-1)] and (g-2) fatty acid salts [hereinafter, also referred to as component (g-2)].

<Component (g-1)>

In the polyoxyethylene alkyl ether sulfate, an average addition mole number of ethylene oxide is preferably 0.5 to 5.0. For component (g-1), preferred are decylsulfates, dodecylsulfates, tetradecylsulfates, and polyoxyethylene decyl ether sulfates, polyoxyethylene dodecyl ether sulfates and polyoxyethylene tetradecyl ether sulfates, having an average addition mole number of ethylene oxide of 1 to 3. For a counter ion of these salts, preferred are sodium, potassium, and ammonium.

<Component (g-2)>

In the detergent composition of the present invention containing a fatty acid salt as component (g-2), defoaming effects tend to increase, because a metal soap formed by binding of component (g-2) with minerals in washing water is more finely dispersed with component (a) than with a usual surfactant. An amount of the fatty acid salt used thus can be decreased. For a ratio of components (a)+(b) to component (g-2), a mass ratio of [(a)+(b)]/(g-2) is preferably 1000/1 to 1/10, more preferably 100/1 to 1/1, even more preferably 50/1 to 2/1, and even more preferably 10/1 to 3/1. For component (g), preferred are fatty acid salts having 12 to 22 carbon atoms. Specific examples thereof include lauric acid, myristic acid, palmitic acid, stearic acid, and oleic acid. For a counter ion of these salts, preferred are sodium and potassium, and particularly preferred is sodium.

For the composition containing component (b) represented by formula (II) or (III), preferred is component (g-2).

<Other Component>

The detergent composition for clothing of the present invention can further contain a surfactant other than the components (a), (b), and (g). Examples of the other surfactant than the components (a), (b), and (g) include anionic surfactants, nonionic surfactants, amphoteric surfactants, cationic surfactants and mixtures thereof. Preferred are anionic surfactants and nonionic surfactants.

For an anionic surfactant other than the components (b) and (g), preferred are alkylbenzenesulfonates, α-sulfofatty acid ester salts, paraffinsulfonates, α-olefin sulfonates, α-sulfofatty acid salts, and α-sulfofatty acid alkyl ester salts. In the present invention, in order to enhance detergent performance at low temperature, a linear alkyl benzenesulfonate having an alkyl chain of 10 to 14 carbon atoms and more preferably 12 to 14 carbon atoms or an α-sulfofatty acid ester salt having an alkyl chain of 12 to 18 carbon atoms and more preferably 14 to 18 carbon atoms can be used together with component (b). For a counter ion of these salts, preferred are alkali metals and amines, more preferred sodium and/or potassium, monoethanolamine and diethanolamine.

From the viewpoint of detergency, in the present invention, an amount used of the anionic surfactant other than the components (b) and (g) is not more than 100% by mass, preferably not more than 70% by mass, more preferably not more than 50% by mass, and even more preferably not more than 30% by mass with respect to component (b).

For the composition containing component (b) represented by formula (II) or (III), from the viewpoint of detergency and solubility of the detergent at low temperature (e.g., 5° C.), the composition preferably further contains the anionic surfactant other than the components (b) and (g). An amount used of the anionic surfactants other than the components (b) and (g) is not less than 1% by mass, preferably not less than 5% by mass, more preferably not less than 10% by mass, and even more preferably not less than 20% by mass with respect to component (b).

For the composition containing component (b) represented by formula (IV), from the viewpoints of increase of detergency at low temperature and preparation, the composition preferably further contains the anionic surfactant other than the components (b) and (g). An amount used of the anionic surfactants other than component (b) is not less than 1% by mass, preferably not less than 2% by mass, more preferably not less than 5% by mass, and even more preferably not less than 10% by mass with respect to component (b).

Preferred examples of a nonionic surfactant other than component (a) include polyoxyalkylene alkyl (8 to 20 carbon atoms) ethers, alkyl polyglycosides, polyoxyalkylene alkyl (8 to 20 carbon atoms) phenyl ethers, polyoxyalkylene sorbitan fatty acid (8 to 22 carbon atoms) esters, polyoxyalkylene glycol fatty acid (8 to 22 carbon atoms) esters, and polyoxyethylene/polyoxypropylene block copolymers. From the viewpoint of enhancing detergent performance, particularly preferred for the nonionic surfactant are polyoxyalkylene alkyl ethers produced by adding 4 to 20 mol of alkylene oxide such as ethylene oxide and propylene oxide to an alcohol having 10 to 18 carbon atoms [e.g., those having an HLB value of 10.5 to 15.0, and preferably 11.0 to 14.5 (calculated by the Griffin's method)].

From the viewpoint of detergency, in the present invention, an amount used of the nonionic surfactant other than component (a) is not more than 100% by mass, preferably not more than 70% by mass, more preferably not more than 50% by mass, and even more preferably not more than 30% by mass with respect to component (a).

For the composition containing component (b) represented by formula (II) or (III), from the viewpoint of detergency and solubility of the detergent at low temperature (e.g., 5° C.), the composition preferably further contains the nonionic surfactant other than component (a). An amount used of the nonionic surfactants other than component (a) is not less than 1% by mass, preferably not less than 5% by mass, more preferably not less than 10% by mass, and even more preferably not less than 20% by mass with respect to component (a).

For the composition containing component (b) represented by formula (IV), from the viewpoints of increase of detergency at low temperature and preparation, the composition preferably further contains the nonionic surfactant other than component (a). An amount used of the nonionic surfactant other than component (a) is not less than 1% by mass, preferably not less than 2% by mass, more preferably not less than 5% by mass, and even more preferably not less than 10% by mass with respect to component (a).

The detergent composition for clothing of the present invention can further contain an organic builder or an inorganic builder other than the components (c) and (d). Examples of the organic builder include carboxylates such as aminocarboxylates, hydroxyaminocarboxylates, hydroxycarboxylates, cyclocarboxylates, maleic acid derivatives and oxalates, and organocarboxylic acid (salt) polymers such as acrylic acid polymers and copolymers, polycarboxylic acid polymers and copolymers, glyoxylic acid polymers, polysaccharides and salts thereof. Organocarboxylic acid (salt) polymers are particularly preferred. For salts of these builders, a counter ion is preferably an alkali metal salt or an amine, and particularly preferably a sodium and/or potassium, monoethanolamine, or diethanolamine. The builder may be used alone or in combination of two or more thereof.

The detergent composition of the present invention containing a carboxylic acid (salt) polymer particularly has high affinity for component (a), and the detergent composition in the form of powder can control water absorption of the polymer. The powder detergent composition thus can contain an increased amount of polymer while keeping anti-caking properties of detergent particles, resulting in increased detergent performance. The detergent composition in the form of liquid has an effect of component (a) to suppress the carboxylic acid (salt) polymer from precipitating and can increase the storage stability.

The detergent composition for clothing of the present invention can further contain other additives such as a bleach (e.g., a percarbonate, a perborate, a bleaching activator), an anti-restaining agent (e.g., carboxymethylcellulose), a softener (e.g., a dialkyl type quaternary ammonium salt, clay mineral), a reducing agent (e.g., a sulfite), a fluorescent brightening agent (e.g., a biphenyl type, an aminostilbenzene type), a foam-controlling agent (e.g., silicone), a fragrance and an enzyme (e.g., protease, cellulase, pectinase, amylase, lipase).

In the detergent composition of the present invention containing a biphenyl or aminostilbenezene fluorescent brightening eaching agent, the fluorescent brightening agent is suppressed from being taken into a micelle of surfactants due to its low solubility in component (a), resulting in a increased adsorption of the fluorescent brightening agent to laundry. An amount of the fluorescent brightening agent used thus can be decreased. According to the similar mechanism, a fragrance, particularly that having a cLogP of not less than 3 is dissolved in a micelle of surfactants in a decreased amount, and thus can leave a perfume to laundry for a longer time and decrease a change of fragrance tone during and after washing. According to the similar mechanism, a silicone can also be adsorbed on laundry in an increased amount.

In the detergent composition of the present invention containing an enzyme, component (a) has low inhibiting rate of enzyme activity and can suppress decrease of the enzyme activity during storage.

When the composition is in the form of granule, from the viewpoints of fluidity and anti-caking properties, it may be subjected to surface modification. For a surface modifier, component (d) can be used. Examples of other surface modifier include silicate compounds such as calcium silicate, silicon dioxide, bentonite, talc, clay, amorphous silica derivatives, and crystalline silicates, metal soap, fine powders such as powdery surfactant, water-soluble polycarboxylate polymers such as carboxymethylcellulose, polyethylene glycol, sodium polyacrylate, copolymers of acrylic acid and maleic acid and salts thereof, and fatty acids. Preferably used is component (d) or a crystalline silicate, and more preferably component (d).

When the composition is in the form of granule, combination use of component (a) and polyethylene glycol increases fluidity in a granulation step and can prevent generation of fine powder. This allows suppression of dust dispersion and increase of anti-caking property.

<Detergent Composition for Clothing>

The detergent composition for clothing of the present invention preferably contains component (a) in an amount of 1 to 80% by mass, more preferably 3 to 40% by mass, and even more preferably 5 to 20% by mass. The detergent composition preferably contains component (b) in an amount of 1 to 80% by mass, more preferably 1.5 to 40% by mass, and even more preferably 2 to 20% by mass. The detergent composition preferably contains component (c) in an amount of 1 to 90% by mass, more preferably 5 to 50% by mass, and even more preferably 10 to 40% by mass. The detergent composition preferably contains component (d) in an amount of 1 to 90% by mass, more preferably 5 to 50% by mass, and even more preferably 10 to 40% by mass.

A mass ratio of the components (a) to (b) influences particularly the performance of the detergent composition. Particularly from the viewpoint of detergency, the mass ratio, component (a)/component (b), is preferably 5/95 to 95/5, more preferably 10/90 to 90/10, and even more preferably 25/75 to 75/25.

In the composition containing component (b) represented by formula (II) or (III), the mass ratio (a)/(b) is preferably 3/7 to 7/3, and more preferably 5/5.

In the composition containing component (b) represented by formula (IV), the mass ratio (a)/(b) is preferably 5/5 to 9/1.

A content of component (e) is preferably 0.001 to 20% by mass, more preferably 0.01% to 10% by mass, and even more preferably 0.1 to 5% by mass with respect to component (a). A content of component (f) is preferably 0.001 to 50% by mass, more preferably 0.01 to 20% by mass, even more preferably 0.01% to 10% by mass, and even more preferably 0.05 to 5% by mass with respect to component (a).

A content of surfactants other than component (a) in the composition is preferably 0.1 to 50% by mass, more preferably 3 to 30% by mass, and even more preferably 5 to 15% by mass. A content of particularly component (g-1) in the composition is preferably 3 to 30% by mass, more preferably 5 to 20% by mass, and even more preferably 5 to 15% by mass. A content of particularly component (g-2) in the composition is preferably 0.1 to 15% by mass, more preferably 1 to 10% by mass, and even more preferably 1 to 5% by mass.

From the viewpoint of detergency, a percentage of anionic surfactants in the total surfactants is preferably 5 to 95% by mass, more preferably 10 to 90% by mass, and even more preferably 25 to 75% by mass.

The detergent composition for clothing of the present invention is preferably in the form of powder, preferably having a bulk density of 300 to 1000 g/L, more preferably 500 to 900 g/L, and even more preferably 600 to 800 g/L. It also preferably has an average particle diameter of 150 to 3000 μm, more preferably 500 to 1500 μm, and even more preferably 600 to 1200 μm.

EXAMPLES

The following Examples are intended to illustrate and compare the present invention and not to limit the present invention.

First, Examples of the composition containing component (b) represented by formula (II) or (III) will be described.

Ingredients described below and shown in Table 1 were used to prepare powder detergent compositions for clothing shown in Table 1. Ingredients described below and shown in Table 2 were used to prepare liquid detergent compositions for clothing shown in Table 2. These detergent compositions were evaluated for detergency according to respective methods described below. Results are shown in Tables 1 and 2.

[1] Ingredients

<AS>

For AS, tetradecylsulfate sodium salt prepared from Kalcol 2098 (Kao Corporation) was used. AS had C12 and C14 alkyl chains at a ratio of C12/C14=2/98 (mass ratio).

<AES>

For AES, polyoxyethylene tetradecyl ether sulfate sodium salt prepared from Kalcol 4098 (Kao Corporation) was used. AES had C12 and C14 alkyl chains at a ratio of C12/C14=2/98 (mass ratio) and an average addition mole number of ethylene oxide (hereinafter, referred to as EO) of 1. In the AES, the content of compounds having an EO addition mole number of not less than 1 was 55.8% by mass.

<LAS>

For LAS, Neopelex G-15 (Kao Corporation) was used.

<Glyceryl Alkyl Ether>

In a 300 mL four-neck flask, under nitrogen flow, 93.2 g (0.50 mol) of lauryl alcohol and 2.94 g (0.0050 mol) of lanthanum triflate were stirred and heated to 90° C. To this was added dropwise 148.16 g (2.0 mol) of glycidol for 24 hours at the temperature, and stirred for additional 2 hours under the same conditions to give 243.5 g of product.

Analysis of the product by gas chromatography showed that a conversion rate of glycidol was not less than 99.9%, lauryl alcohol was 6.0% by mass, and a content of polyglycerol was 2.2% by mass. Analysis also showed that in the resultant lauryl polyglycerol ether, a percentage of compounds each having a condensation degree of glycerol n of 3 to 5 in the total compounds having n of 1 to 7 was 43.3% by mass. It was thus confirmed that the product [glyceryl alkyl ether] contained compounds having different condensation degrees n's of glycerol, each having a condensation degrees of 3 to 5.

The product was further subjected to column separation to collect components (a1) and (a2). The components (a1) and (a2) were measured for molecular weight by mass spectroscopy and used as standard samples for gas chromatography. The product (lauryl polyglyceryl ether) was analyzed by gas chromatography to quantify compounds having condensation degrees of glycerol of 1 and 2. It is shown in results that the contents of compounds having condensation degrees of glycerol of 1 and 2 were 12.2% by mass and 11.4% by mass, respectively.

glyceryl alkyl ether (a1): having a molecular weight of not less than 220 and less than 300 (corresponding to a condensation degree of glycerol of 1)

glyceryl alkyl ether (a2): having a molecular weight of not less than 300 and less than 360 (corresponding to a condensation degree of glycerol of 2)

<AE>

For AE, a polyoxyethylene alkyl ether (Kao Corporation) was used. AE had C12 and C14 alkyl chains at a ratio of C12/C14=72/28 (mass ratio) and an average addition mole number of EO of 6.

<Polymer>

Polyacrylic acid (weight average molecular weight: 15000, measured by GPC, based on polyethylene glycol standard)

<Zeolite>

For a zeolite, a 4A zeolite having an average particle diameter of 3 μm (Tosoh Corporation) was used.

[2] Method of Evaluating Detergency of a Powder Detergent Composition 0.667 g of a detergent composition shown in Table 1 was dissolved in 1 L of tap water. To this were added five pieces of cloth stained with spinach, which were prepared as described below, and washed for 10 minutes with a Terg-O-Tometer at 80 round/min and 20° C. Test pieces were sufficiently rinsed and dried. A detergency was determined according to the following formula.

detergency(%)=(reflectance after washing−reflectance before washing)/(reflectance of clean cloth−reflectance before washing)×100

A reflectance was measured using NDR-10DP manufactured by Nippon Denshoku Industries Co., Ltd. with a 460 nm filter.

[3] Method of Evaluating Detergency of a Liquid Detergent Composition 0.833 g of a liquid detergent composition shown in Table 2 was dissolved in 1 L of tap water. To this were added five pieces of cloth stained with spinach, which were prepared as described below, and washed for 10 minutes with a Terg-O-Tometer at 80 round/min and 20° C. (liquid temperature). Test pieces were sufficiently rinsed and dried. A detergency was determined in the same way as for a powder detergent composition.

<Preparation of Cloth Stained with Spinach>

Commercially available spinach was pureed with a blender. A liquid part of the puree was filtered through cotton cloth. 0.5 g of the resultant liquid was uniformly applied on 6 cm by 6 cm of cotton test cloth #2023, and dried for 12 hours at 20° C. The dried cloth was used in the test.

TABLE 1

| | | | Example | | | | | | | | | | |
|---|---|---|---|---|---|---|---|---|---|---|---|---|---|
| | | | 1 | 2 | 3 | 4 | 5 | 6 | 7 | 8 | 9 | 10 | 11 |
| Powdery detergent composition | Compounding component (mass %) | (a) Glyceryl alkyl ether | 2.4 | 6 | 10 | 14 | 17.6 | 2.4 | 6 | 10 | 14 | 17.6 | 7.3 |
| | | (b) AS | 17.6 | 14 | 10 | 6 | 2.4 | | | | | | 10 |
| | | AES | | | | | | 17.6 | 14 | 10 | 6 | 2.4 | |
| | | LAS | | | | | | | | | | | |
| | | AE | | | | | | | | | | | 2.7 |
| | | Polymer | 6 | 6 | 6 | 6 | 6 | 6 | 6 | 6 | 6 | 6 | 6 |
| | | Sodium carbonate | 25 | 25 | 25 | 25 | 25 | 25 | 25 | 25 | 25 | 25 | 25 |
| | | Zeolite | 30 | 30 | 30 | 30 | 30 | 30 | 30 | 30 | 30 | 30 | 30 |
| | | Sodium sulfate | Balance | Balance | Balance | Balance | Balance | Balance | Balance | Balance | Balance | Balance | Balance |
| | | Total | 100 | 100 | 100 | 100 | 100 | 100 | 100 | 100 | 100 | 100 | 100 |
| | Ratio of anionic surfactant (% by mass) | | 85 | 70 | 50 | 30 | 15 | 85 | 70 | 50 | 30 | 15 | 50 |
| detergency (20° C.) (%) | | | 45 | 51 | 51 | 43 | 37 | 50 | 50 | 49 | 43 | 37 | 50 |

| | | | Comparative example | | | | | | | | | | |
|---|---|---|---|---|---|---|---|---|---|---|---|---|---|
| | | | 1 | 2 | 3 | 4 | 5 | 6 | 7 | 8 | 9 | 10 | 11 |
| Powdery detergent composition | Compounding component (mass %) | (a) Glyceryl alkyl ether | 20 | | | | 2.4 | 6 | 10 | 14 | 17.6 | | |
| | | (b) AS | | 20 | | | | | | | | | 10 |
| | | AES | | | 20 | | | | | | | | |

TABLE 1-continued

| | | | | | | | | | | | | |
|---|---|---|---|---|---|---|---|---|---|---|---|---|
| | LAS | | | | 20 | 17.6 | 14 | 10 | 6 | 2.4 | | |
| | AE | | | | | | | | | | 20 | 10 |
| | Polymer | 6 | 6 | 6 | 6 | 6 | 6 | 6 | 6 | 6 | 6 | 6 |
| | Sodium carbonate | 25 | 25 | 25 | 25 | 25 | 25 | 25 | 25 | 25 | 25 | 25 |
| | Zeolite | 30 | 30 | 30 | 30 | 30 | 30 | 30 | 30 | 30 | 30 | 30 |
| | Sodium sulfate | Balance | Balance | Balance | Balance | Balance | Balance | Balance | Balance | Balance | Balance | Balance |
| | Total | 100 | 100 | 100 | 100 | 100 | 100 | 100 | 100 | 100 | 100 | 100 |
| Ratio of anionic surfactant (% by mass) | | 0 | 100 | 100 | 100 | 85 | 70 | 50 | 30 | 15 | 0 | 50 |
| detergency (20° C.) (%) | | 27 | 35 | 36 | 35 | 35 | 34 | 34 | 33 | 30 | 27 | 35 |

cf. In compositions of Table 1, a ratio of anionic surfactant is calculated by the following formula.

ratio of anionic surfactant(% by mass)=anionic surfactant/(anionic surfactant+nonionic surfactant)×100 wherein, the "anionic surfactant" refers to a percentage by mass of anionic surfactants determined by [AS (% by mass)+AES(% by mass)+LAS (% by mass)]; the "nonionic surfactant" refers to a percentage by mass of nonionic surfactants determined by [glyceryl alkyl ether (% by mass)+AE (% by mass)]. In Table 1, the "rest part" of sodium sulfate refers to an amount that makes the total mass of the composition 100.

TABLE 2

| | | | Example | Comparative example | |
|---|---|---|---|---|---|
| | | | 12 | 12 | 13 |
| Liquid detergent composition | Compounding component (% by mass) | (a) Glyceryl alkyl ether | 23 | 31 | 0 |
| | | (b) AS | 8 | 0 | 31 |
| | | Propylene glycol | 5 | 5 | 5 |
| | | Monoethanol amine | 2 | 2 | 2 |
| | | Sodium hydroxide | Adjusting amount | Adjusting amount | Adjusting amount |
| | | Ethanol | 2 | 2 | 2 |
| | | Polymer | 3 | 3 | 3 |
| | | Citric acid | 0.5 | 0.5 | 0.5 |
| | | Water | Balance | Balance | Balance |
| | | Total | 100 | 100 | 100 |
| detergency (20° C.) (%) | | | 40 | 23 | 33 |

In Table 2, the "adjusting amount" of sodium hydroxide refers to an amount that makes a pH of the composition 9 (20° C.). The "rest part" of water refers to an amount that makes the total mass of the composition 100.

Next, Examples of the composition containing component (b) represented by formula (IV) will be described.

Ingredients described below and shown in Table 3 were used to prepare powder detergent compositions for clothing shown in Table 3. Ingredients described below and shown in Table 4 were used to prepare liquid detergent compositions for clothing shown in Table 4. These detergent compositions were evaluated for detergency according to respective methods described below. Results are shown in Tables 3 and 4.

[1] Ingredients

<Alkyl Ether Sulfate (b1)

In an autoclave equipped with a stirrer, a temperature controller, and an automatic introduction device, 2340 g of C12 linear alcohol (Kao Corporation, product name: Kalcol 2098) and 3.5 g of KOH were dehydrated for 30 minutes at 110° C. and 1.3 kPa. Then, the inner atmosphere was replaced with nitrogen. The reaction mixture was heated to 120° C. and 1460 g of propylene oxide was fed. Addition reaction and aging were carried out at 120° C. The reaction mixture was cooled to 80° C. Unreacted propylene oxide was removed at 4.0 kPa. Then, 3.8 g of acetic acid was added to the autoclave and stirred for 30 minutes at 80° C. The product mixture was taken out to obtain an alkoxylate in which an average addition mole number of propylene oxide was 2.0.

The resultant alkoxylate was sulfated with $SO_3$ gas in a falling-film reactor (hereinafter, referred to as FFR). The sulfated product was neutralized with an aqueous NaOH solution to give a composition containing polyoxypropylene alkyl ether sulfate.

From GC analysis, the resultant composition contained 98% by mass of polyoxypropylene alkyl ether sulfate having a structure added with one mole or more of propylene oxide and 2% by mass of alkylsulfate.

<Alkyl Ether Sulfate (b2)>

In an autoclave equipped with a stirrer, a temperature controller, and an automatic introduction device, 2340 g of C12 linear alcohol (Kao Corporation, product name: Kalcol 2098) and 3.5 g of KOH were dehydrated for 30 minutes at 110° C. and 1.3 kPa. Then, the inner atmosphere was replaced with nitrogen. The reaction mixture was heated to 120° C. and 511 g of propylene oxide was fed. Addition reaction and aging were carried out at 120° C. The reaction mixture was heated to 145° C. and 1107 g of ethylene oxide was fed. Addition reaction and aging were carried out at 145° C. The reaction mixture was cooled to 80° C. Unreacted ethylene oxide was removed at 4.0 kPa. Then, 3.8 g of acetic acid was added to the autoclave and stirred for 30 minutes at 80° C. The product mixture was taken out to obtain an alkoxylate in which an average PO addition mole number was 0.7 and an average EO addition mole number was 2.0.

The resultant alkoxylate was sulfated with $SO_3$ gas in a falling-film reactor (hereinafter, referred to as FFR). The sulfated product was neutralized with an aqueous NaOH solution to obtain a composition containing alkyl ether sulfate.

From GC and NMR analysis, the resultant composition contained 60% by mass of sulfate having a structure added with one mole or more of propylene oxide.

LAS, a glyceryl alkyl ether, AE, a polymer, and a zeolite were the same as those used above.

Evaluation for detergency of a powder detergent composition and evaluation for detergency of a liquid detergent composition were carried out in the same way as performed as above, except that a washing temperature was 5° C. (liquid temperature). That is, evaluations for detergency were performed at 5° C. to examine detergency at low temperature. A cloth stained with spinach was prepared as the above.

cf. Annotations in Tables 3 and 4 are the same as those in Tables 1 and 2.

The invention claimed is:

1. A detergent composition for clothing comprising:

(a) glyceryl monoether or polyglyceryl monoether, represented by formula (I); and (b) a sulfate represented by formula (IV), wherein component (a) comprises plural compounds having different condensation degrees n's of glycerol; and the content of compounds each having an alkyl group having 12 and/or 14 carbon atoms as R in formula (I) and a condensation degree n of glycerol of 3 to 5 is not less

TABLE 3

| | | | Example | | | | | | | | | |
|---|---|---|---|---|---|---|---|---|---|---|---|---|
| | | | 2-1 | 2-2 | 2-3 | 2-4 | 2-5 | 2-6 | 2-7 | 2-8 | 2-9 | 2-10 |
| Powdery detergent composition | Compounding component (mass %) | (a) Glyceryl alkyl ether | 2.4 | 6 | 10 | 15 | 2.4 | 6 | 10 | 15 | 10 | 7 |
| | | (b) Alkyl ether sulfate(b1) | 17.6 | 14 | 10 | 5 | | | | | 7 | 10 |
| | | Alkyl ether sulfate(b2) | | | | | 17.6 | 14 | 10 | 5 | | |
| | | LAS | | | | | | | | | 3 | |
| | | AE | | | | | | | | | | 3 |
| | | Polymer | 6 | 6 | 6 | 6 | 6 | 6 | 6 | 6 | 6 | 6 |
| | | Sodium carbonate | 25 | 25 | 25 | 25 | 25 | 25 | 25 | 25 | 25 | 25 |
| | | Zeolite | 30 | 30 | 30 | 30 | 30 | 30 | 30 | 30 | 30 | 30 |
| | | Sodium sulfate | Balance | Balance | Balance | Balance | Balance | Balance | Balance | Balance | Balance | Balance |
| | | Total | 100 | 100 | 100 | 100 | 100 | 100 | 100 | 100 | 100 | 100 |
| | Ratio of anionic surfactant (mass %) | | 85 | 70 | 50 | 25 | 85 | 70 | 50 | 25 | 50 | 50 |
| Deteregency (5° C.) (%) | | | 34 | 33 | 32 | 31 | 31 | 31 | 30 | 30 | 31 | 31 |

| | | | Comparative example | | | | | | | | | |
|---|---|---|---|---|---|---|---|---|---|---|---|---|
| | | | 2-1 | 2-2 | 2-3 | 2-4 | 2-5 | 2-6 | 2-7 | 2-8 | 2-9 | 2-10 |
| Powdery detergent composition | Compounding component (mass %) | (a) Glyceryl alkyl ether | 20 | | | | 2.4 | 6 | 10 | 15 | | |
| | | (b) Alkyl ether sulfate(b1) | | 20 | | | | | | | | 10 |
| | | Alkyl ether sulfate(b2) | | | 20 | | | | | | | |
| | | LAS | | | | 20 | 17.6 | 14 | 10 | 5 | | |
| | | AE | | | | | | | | | 20 | 10 |
| | | Polymer | 6 | 6 | 6 | 6 | 6 | 6 | 6 | 6 | 6 | 6 |
| | | Sodium carbonate | 25 | 25 | 25 | 25 | 25 | 25 | 25 | 25 | 25 | 25 |
| | | Zeolite | 30 | 30 | 30 | 30 | 30 | 30 | 30 | 30 | 30 | 30 |
| | | Sodium sulfate | Balance | Balance | Balance | Balance | Balance | Balance | Balance | Balance | Balance | Balance |
| | | Total | 100 | 100 | 100 | 100 | 100 | 100 | 100 | 100 | 100 | 100 |
| | Ratio of anionic surfactant (mass %) | | 0 | 100 | 100 | 100 | 85 | 70 | 50 | 25 | 0 | 50 |
| Deteregency (5° C.) (%) | | | 24 | 30 | 28 | 25 | 25 | 24 | 24 | 24 | 25 | 24 |

TABLE 4

| | | | Example | Comparative example | |
|---|---|---|---|---|---|
| | | | 2-11 | 2-11 | 2-12 |
| Liquid detergent composition | Compounding composition (mass %) | (a) Glyceryl alkyl ether | 23 | 31 | 0 |
| | | (b) Alkyl ether sulfate (b1) | 8 | 0 | 31 |
| | | Propylene glycol | 5 | 5 | 5 |
| | | Monoethanol amine | 2 | 2 | 2 |
| | | Sodium hydroxide | Adjusting amount | Adjusting amount | Adjusting amount |
| | | Ethanol | 2 | 2 | 2 |
| | | Polymer | 3 | 3 | 3 |
| | | Citric acid | 0.5 | 0.5 | 0.5 |
| | | Water | Balance | Balance | Balance |
| | | Total | 100 | 100 | 100 |
| Detergency (5° C.) (%) | | | 30 | 22 | 24 |

than 40% by mass of compounds represented by formula (I) and having a condensation degree of glycerol n of 1 to 7 in component (a):

$$R—O—(C_3H_6O_2)_n—H \quad (I)$$

wherein, R represents a hydrocarbon group having 6 to 22 carbon atoms; and n represents a condensation degree of glycerol and is an integer:

$$R^1—O-(A^1O)_p-(AO)_q—SO_3M \quad (IV)$$

wherein, $R^1$ represents a hydrocarbon group having 6 to 22 carbon atoms; $A^1O$ represents an oxypropylene group and/or an oxybutylene group; AO represents an oxyalkylene group comprising at least one of oxyethylene, oxypropylene and oxybutylene group; p represents an integer of 1 to 5; q represents an integer of 0 to 10; and, M represents an alkali metal, an alkaline earth metal, $NH_4$ or an alkanolammonium group having 2 to 3 carbon atoms.

2. The detergent composition for clothing according to claim 1, wherein the content of compounds each having a condensation degree n of glycerol of 1 or 2 is less than 50% by mass of component (a).

3. The detergent composition for clothing according to claim 1, further comprising an alcohol having 6 to 22 carbon atoms in an amount of 0.001 to 20% by mass with respect to component (a).

4. The detergent composition for clothing according to to claim 1, further comprising at least one compound selected from the group consisting of glycerol and polyglycerol in an amount of 0.001 to 50% by mass with respect to component (a).

5. The detergent composition for clothing according to claim 1, wherein R of formula (I) for component (a) represents an alkyl group having 12 and/or 14 carbon atoms, and n represents an integer from 3 to 5.

6. The detergent composition for clothing according to claim 1, wherein component (a) comprises three or more compounds having different condensation degrees n's of glycerol.

7. The detergent composition for clothing according to claim 6, wherein the compounds in component (a) have condensation degrees n's of glycerol of 3, 4 and 5.

* * * * *